US011548763B2

(12) United States Patent
Zhao

(10) Patent No.: US 11,548,763 B2
(45) Date of Patent: Jan. 10, 2023

(54) LOAD BEARING TRACTION MEMBERS AND METHOD

(71) Applicant: OTIS ELEVATOR CORPORATION, Farmington, CT (US)

(72) Inventor: Chen Qian Zhao, Newark, DE (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1069 days.

(21) Appl. No.: 16/101,097

(22) Filed: Aug. 10, 2018

(65) Prior Publication Data

US 2020/0048043 A1 Feb. 13, 2020

(51) Int. Cl.

| | |
|---|---|
| ***B66B 7/06*** | (2006.01) |
| ***D07B 1/00*** | (2006.01) |
| ***D07B 1/02*** | (2006.01) |
| ***D07B 1/04*** | (2006.01) |
| ***D07B 1/06*** | (2006.01) |

(52) U.S. Cl.

CPC ..... *B66B 7/06* (2013.01); *D07B 1/005* (2013.01); *D07B 1/025* (2013.01); *D07B 1/04* (2013.01); *D07B 1/0686* (2013.01); *D07B 2201/102* (2013.01); *D07B 2201/104* (2013.01); *D07B 2201/2023* (2013.01); *D07B 2201/2065* (2013.01); *D07B 2201/2068* (2013.01); *D07B 2201/2087* (2013.01); *D07B 2205/205* (2013.01); *D07B 2205/2096* (2013.01); *D07B 2501/2007* (2013.01)

(58) Field of Classification Search

CPC . D07B 1/02; D07B 1/025; D07B 1/16; D07B 1/162; D07B 1/165; D07B 2201/2087; D07B 2201/2088; D07B 2205/2042

See application file for complete search history.

(56) References Cited

U.S. PATENT DOCUMENTS

| | | | |
|---|---|---|---|
| 4,624,097 | A | 11/1986 | Wilcox |
| 5,834,942 | A | 11/1998 | De Angelis |
| 6,412,264 | B1 | 7/2002 | De Josez et al. |
| 6,945,153 | B2 | 9/2005 | Knudsen et al. |
| 8,100,796 | B2 | 1/2012 | O'Donnell |
| 8,176,718 | B2 | 5/2012 | Ridge et al. |
| 8,807,286 | B2 | 8/2014 | Puranen et al. |

(Continued)

FOREIGN PATENT DOCUMENTS

| | | | |
|---|---|---|---|
| CN | 106192494 | A | 12/2016 |
| DE | 102009006063 | A1 | 7/2010 |

(Continued)

OTHER PUBLICATIONS

European Search Report for application EP 19191342.5, dated Mar. 2, 2020, 8 pages.

(Continued)

*Primary Examiner* — Shaun R Hurley

(74) *Attorney, Agent, or Firm* — Cantor Colburn LLP

(57) ABSTRACT

A lifting member for an elevator system is disclosed, including a rope formed from a plurality of strands comprising liquid crystal polymer fibers, with the strands extending along a length of the lifting member. A first polymer coating is disposed on outer surfaces of the fibers or on outer surfaces of the strands. A second polymer coating disposed over the first polymer coating.

20 Claims, 5 Drawing Sheets

(56) References Cited

U.S. PATENT DOCUMENTS

| | | | | |
|---|---|---|---|---|
| 9,126,805 | B2 | 9/2015 | Pelto-Huikko et al. | |
| 9,506,188 | B2 | 11/2016 | Pourladian et al. | |
| 9,708,758 | B2 | 7/2017 | Amils et al. | |
| 9,828,214 | B2 | 11/2017 | Pelto-Huikko et al. | |
| 9,944,494 | B2 | 4/2018 | Alasentie et al. | |
| 9,994,994 | B2 | 6/2018 | Amils et al. | |
| 2010/0192758 | A1* | 8/2010 | Clough | D04C 1/02 87/8 |
| 2011/0259677 | A1* | 10/2011 | Dudde | D07B 1/145 187/411 |
| 2017/0328001 | A1* | 11/2017 | Kirth | D07B 1/025 |
| 2018/0127240 | A1 | 5/2018 | Zafiris et al. | |
| 2018/0186604 | A1* | 7/2018 | Helenius | D07B 1/162 |
| 2019/0318841 | A1* | 10/2019 | Hornung | H01B 7/0216 |

FOREIGN PATENT DOCUMENTS

| | | | |
|---|---|---|---|
| EP | 2067893 | A2 | 6/2009 |
| EP | 2361212 | B1 | 2/2014 |
| EP | 3492417 | A2 | 6/2019 |

OTHER PUBLICATIONS

European Office Action for EP application No. 19191342.5-1017; dated Aug. 26, 2022; 15 pages.

* cited by examiner

LOAD BEARING TRACTION MEMBERS AND METHOD

BACKGROUND

Exemplary embodiments pertain to the field of load-bearing traction members such as for elevator systems.

Load-bearing members can be used in a wide variety of mechanical equipment and processes. One example of a use for load-bearing members is in transportation such as for elevator or escalator systems. Elevator systems typically include a cab and a counterweight that move within a hoistway to transport passengers or cargo to different landings within a building. A load-bearing member such as a cable or belt connects the cab and counterweight, and during operation the load-bearing moves over one or more sheaves mounted to the building structure as the cab and counterweight move to different positions.

A common configuration for load-bearing members includes a tension member core such as one or more steel cords and a polymer jacket disposed around the core. The cords act as the load supporting tension member, while the jacket holds the cords in a stable position relative to each other, and provides a frictional load path to provide traction for driving the belt. However, such steel cords can render the lifting member too heavy for high rise elevator use. Carbon fiber belts, utilizing composite tension elements in the load bearing member will provide improved strength to weight advantages compared to steel cord belt. Such belts, however, require a relatively rigid thermoset matrix to protect fragile carbon fiber, and such a matrix material can reduce flexibility of the lifting member.

BRIEF DESCRIPTION

A lifting member for an elevator system is disclosed, comprising a rope formed from a plurality of strands comprising liquid crystal polymer fibers, with the strands extending along a length of the lifting member. A first polymer coating is disposed on outer surfaces of the fibers or on outer surfaces of the strands. A second polymer coating disposed over the first polymer coating.

In some embodiments, the first polymer includes active groups selected from glycidyl, carboxyl, amino, silane, isocyanate, amide or hydroxyl.

In any one or combination of the foregoing embodiments, the first polymer coating comprises an acrylic polymer, an epoxy polymer, a urethane polymer, silane grafted polymer, melamine resins, or acrylamide polymer.

In any one or combination of the foregoing embodiments, the liquid crystal polymer comprises an aromatic polyester.

In any one or combination of the foregoing embodiments, the strands comprise at least 50 wt. % liquid crystal polymer fibers, based on total weight of the strands.

In any one or combination of the foregoing embodiments, the strands further comprise fibers selected from carbon fibers, glass fibers, ultrahigh molecular weight polyethylene fibers, polybenzoxazole fibers, or polyamide fibers.

In any one or combination of the foregoing embodiments, the second polymer coating comprises an elastomeric polymer selected from thermoplastic polyurethane, polyamides, olefins, elastomers, EPDM, fluoropolymers, chloropolymers, chlorosulfurno elastomers.

In any one or combination of the foregoing embodiments, the lifting member can further comprise a third coating over the second coating, comprising a thermoplastic polyurethane or ethylene propylene diene polymer.

In any one or combination of the foregoing embodiments, the third polymer coating further includes a flame retardant, or a UV stabilizer, or both a flame retardant and a UV stabilizer.

A method of making the lifting element of any one or combination of the foregoing embodiments is also disclosed. According to the method, a plurality of strands is provided comprising liquid crystal polymer fiber filaments, with the fiber filaments or said strands coated with the first polymer or a precursor to the first polymer. The plurality of strands are formed into a rope, and the second polymer is disposed over the plurality of strands.

In some embodiments, the aforementioned method further comprises forming the strands from said liquid crystal polymer fiber filaments, with the filaments coated with the first polymer or precursor to the first polymer.

Another method of making the lifting element of any one or combination of the foregoing embodiments is also disclosed. According to the method, a plurality of strands comprising liquid crystal polymer fiber filaments are formed into a rope, and the rope is impregnated with a fluid composition comprising the first polymer or a precursor to the first polymer. The second polymer is then disposed over the impregnated strands.

An elevator system is also disclosed, comprising a hoistway, an elevator car disposed in the hoistway and movable therein, and a lifting member according to any one or combination of the foregoing embodiments. The lifting member is operably connected to the elevator car to suspend and/or drive the elevator car along the hoistway.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
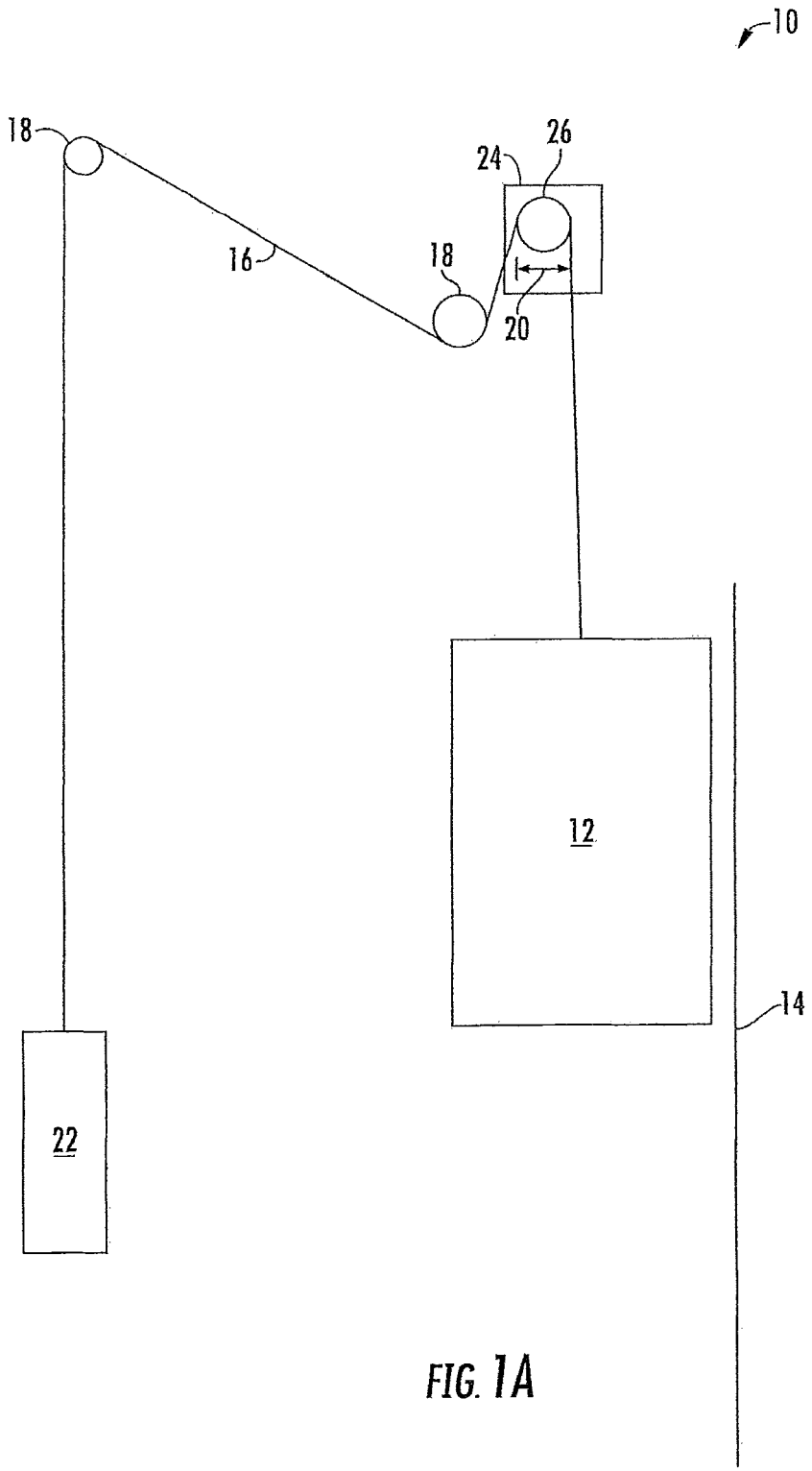
FIG. 1A is a schematic view of an example embodiment of an elevator system.
Figure 1B:
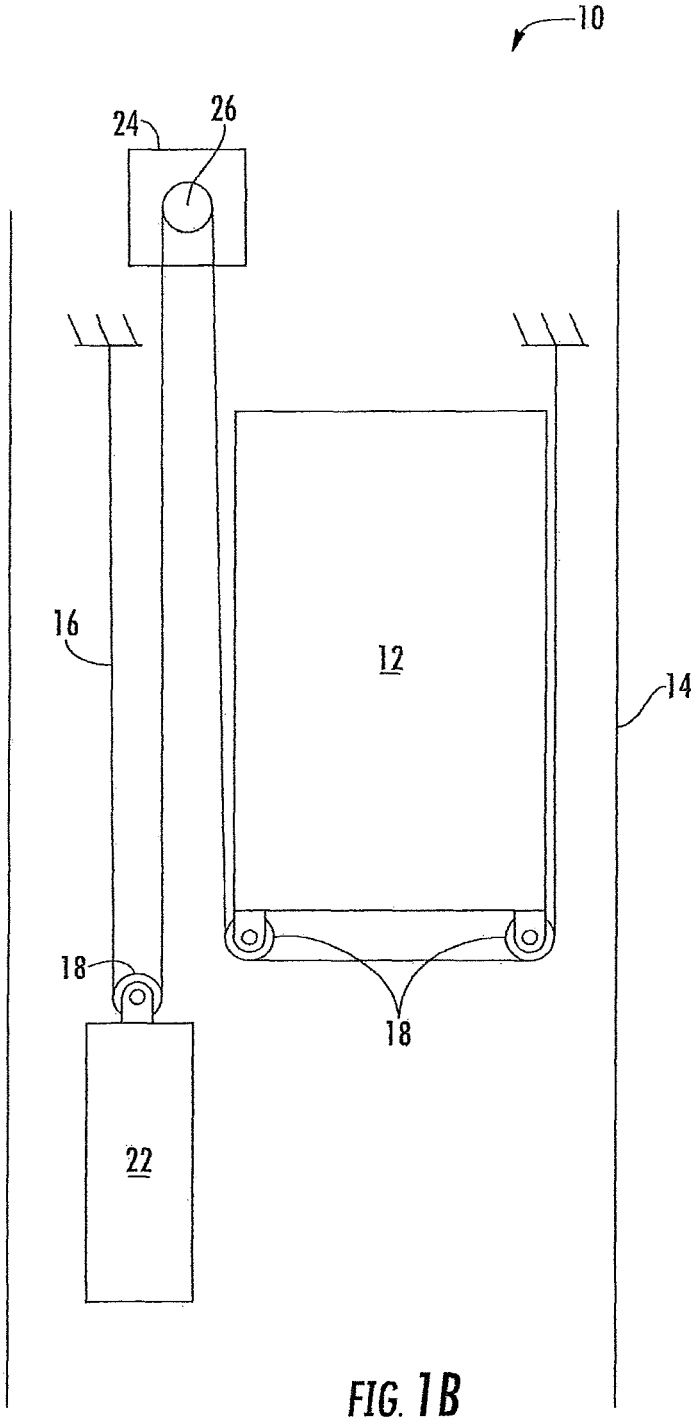
FIG. 1B is a schematic view of another example embodiment of an elevator system.
Figure 1C:
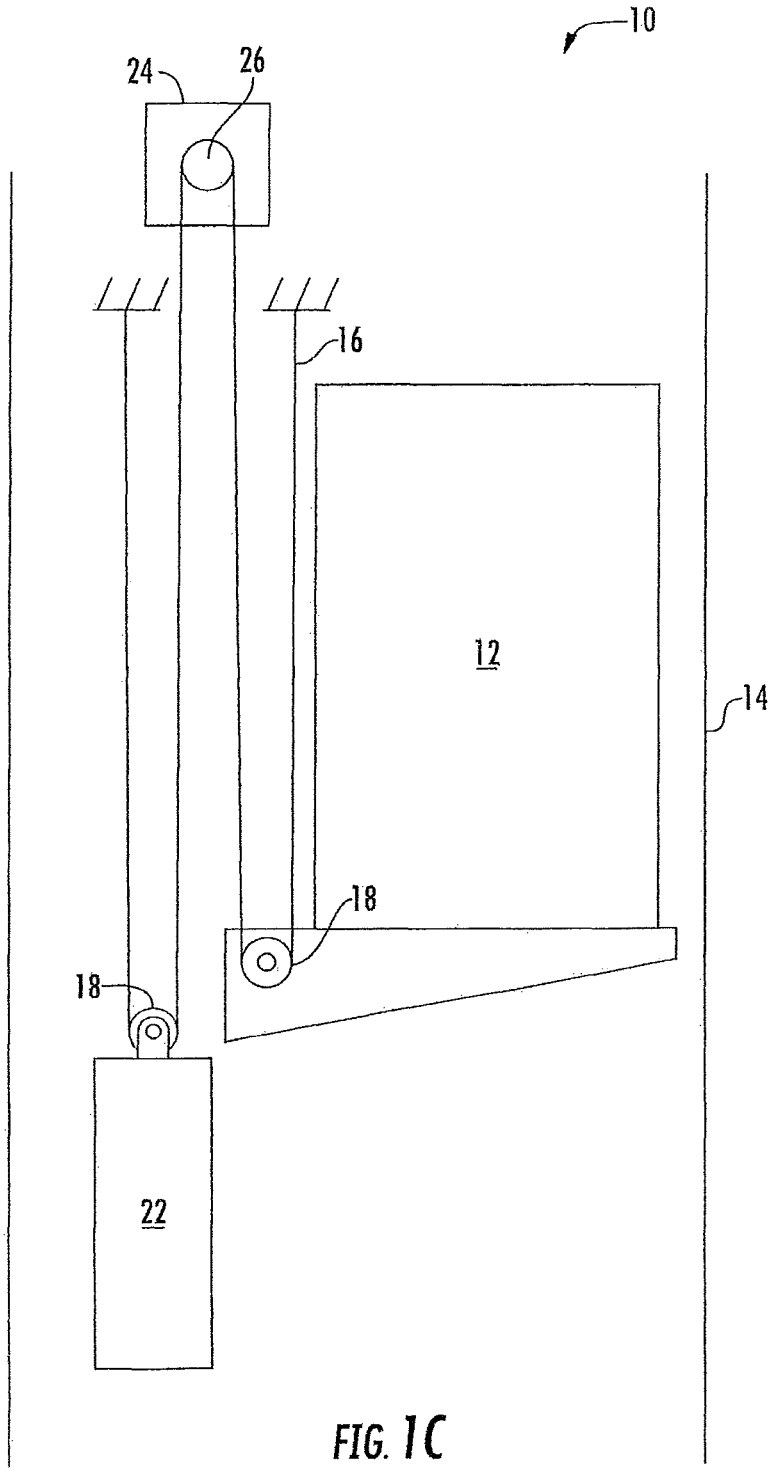
FIG. 1C is a schematic view of yet another example embodiment of an elevator system.

Shown in FIGS. 1A, 1B and 1C are schematics of exemplary traction elevator systems 10. Features of the elevator system 10 that are not required for an understanding of the present disclosure (such as the guide rails, safeties, etc.) are not discussed herein. The elevator system 10 includes an elevator car 12 operatively suspended or supported in a hoistway 14 with one or more lifting members 16. The one or more lifting members 16 interact with one or more sheaves 18 to be routed around various components of the elevator system 10. The one or more lifting members 16 could also be connected to a counterweight 22, which is used to help balance the elevator system 10 and reduce the difference in tension on both sides of the traction sheave during operation.

The sheaves 18 each have a diameter 20, which may be the same or different than the diameters of the other sheaves 18 in the elevator system 10. At least one of the sheaves could be a drive sheave 26. The drive sheave 26 is driven by a machine 24. Movement of the drive sheave 26 by the machine 24 drives, moves and/or propels (through traction) the one or more lifting members 16 that are routed around the drive sheave 26. At least one of the sheaves 18 could be a diverter, deflector or idler sheave 18. Diverter, deflector or idler sheaves 18 are not driven by the machine 24, but help guide the one or more lifting members 16 around the various components of the elevator system 10.

In some embodiments, the elevator system 10 could use two or more lifting members 16 for suspending and/or driving the elevator car 12. In addition, the elevator system 10 could have various configurations such that either both sides of the one or more lifting members 16 engage the one or more sheaves 18 (such as shown in the exemplary elevator systems in FIGS. 1A, 1B or 1C).

FIG. 1A provides a 1:1 roping arrangement in which the one or more lifting members 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more lifting members 16 and the one or more lifting members 16 can terminate elsewhere, typically at a structure within the hoistway 14 (such as for a machine room-less elevator system) or within the machine room (for elevator systems utilizing a machine room. The number of sheaves 18 used in the arrangement determines the specific roping ratio (e.g. the 2:1 roping ratio shown in FIGS. 1B and 1C or a different ratio). One skilled in the art will readily appreciate that the configurations of the present disclosure could be used on elevator systems other than the exemplary types shown in FIGS. 1A, 1B, and 1C.

Figure 2:
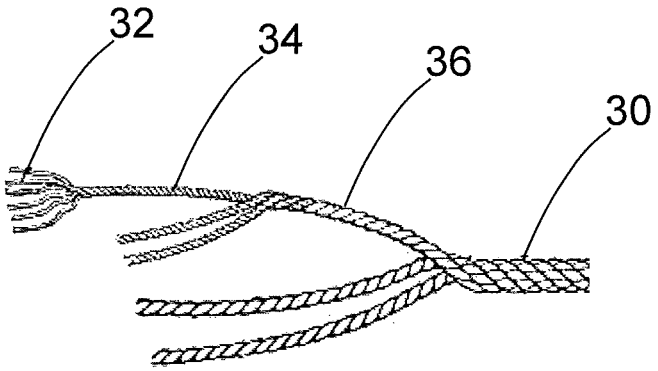
FIG. 2 schematically shows an example embodiment of a rope configuration.

With reference now to FIG. 2, a cross-sectional view of an exemplary lifting member 16 is shown. The lifting member 16 can be constructed to have sufficient flexibility when passing over the one or more sheaves 18 to provide low bending stresses, meet life requirements and have smooth operation, while being sufficiently strong to be capable of meeting strength requirements for suspending and/or driving the elevator car 12. As shown in FIG. 2, a rope 30 is formed from fibers 32. The fibers can be in the form of filaments (e.g., monofilaments) that can be formed into strands by twisting or winding or other techniques. Although short filaments can be twisted together to make strands, in some embodiments the filaments can be long filaments extending up to the full length of the rope. As shown in FIG. 2, the fibers 32 are twisted into a first strand (also known as a yarn) 34, and a number of the yarns 34 are twisted or wound together to form strands 36, which are wound together to form the rope 30. Of course, the rope 30 shown in FIG. 2 is merely a representative example of one rope-forming technique. Many others can be used including various braiding and winding techniques, as well as other rope structures such as parallel core and various types of lay structures used for metal wire ropes. For example, in some embodiments, the strands 36 could be braided instead of wound. Also, FIG. 2 shows only three hierarchical levels of fiber combination (yarns 34, strands 36, and rope 30), but additional levels can be employed. For example, in some embodiments, the structure identified in FIG. 2 as rope 30 could itself be a strand, combined with other strands by braiding, twisting, or winding, into a larger rope structure.

Figure 3:
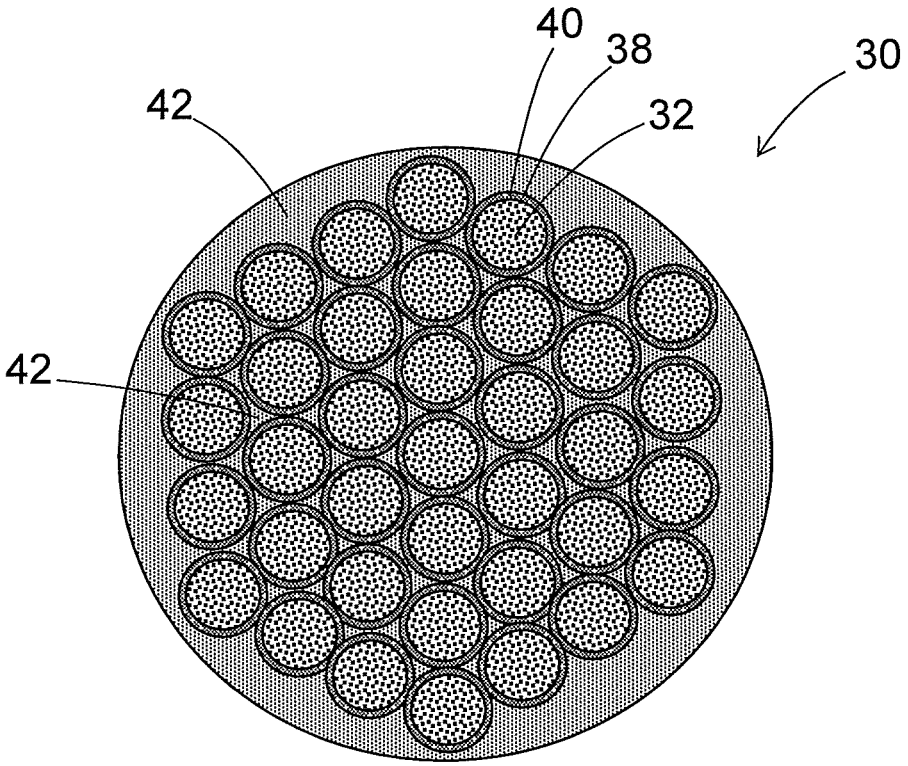
FIG. 3 schematically shows a cross-sectional view of an example embodiment of a rope.
Figure 4:
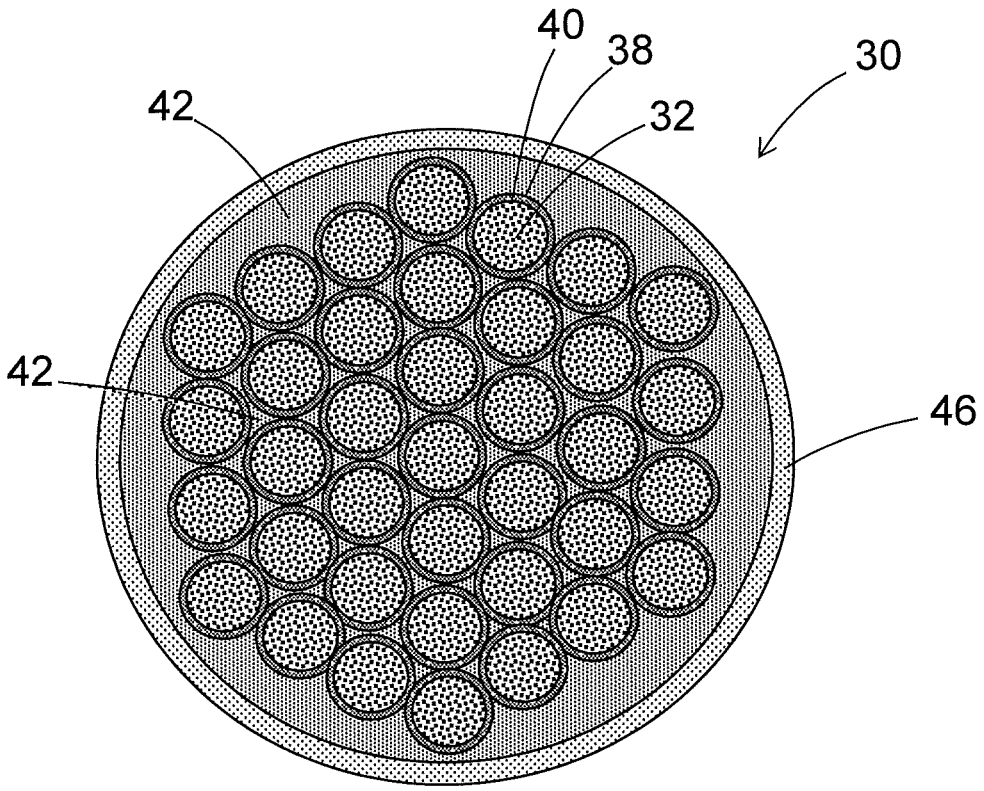
FIG. 4 schematically shows a cross-sectional view of another example embodiment of a rope.

The disclosure is further described and explained below with reference to cross-sectional views shown in FIGS. 3 and 4 of an exemplary embodiment of a rope. With reference now to FIGS. 3 and 4, the cross-section of rope 30 includes a number of strands 38 that individually comprise fibers 32. As mentioned above, the fibers used for the ropes described herein include liquid crystal polymer fibers. Liquid crystal polymers fibers can include lyotropic polymer fibers or thermotropic polymer fibers. Lyotropic polymers decompose before melting but form liquid crystals in solution under appropriate conditions, and accordingly these polymer fibers are typically spun from solution. Examples of lyotropic polymers for fibers can include aramid or polyphenylene benzobisoxazole (PBO) polymers. Thermotropic polymers exhibit liquid crystal formation in melt form, and accordingly these polymer fibers are typically spun from a melt. Examples of thermotropic polymers for fibers include aromatic polyesters such as the polycondensation product of 4-hydroxybenzoic acid and 6-hydroxynaphthalene-2-carboxylic acid. Fiber based rope diameter can range from 0.5-60 mm. In some embodiments, the strands can include other fibers in addition to the LCP fibers. Such additional fibers can include, but are not limited to carbon fibers, glass fibers, ultrahigh molecular weight (e.g., macromolecule lengths of 100,000-250,000 monomer units) polyethylene fibers, polybenzoxazole fibers, polyamide fibers, or metal fibers (e.g., steel). In some embodiments, the strands are free of metal fibers. In some embodiments, the strands include liquid crystal polymer fibers in an amount of at least 10 wt. %, or at least 20 wt. %, or at least 30 wt. %, or at least 40 wt. %, or at least 50 wt. %, or at least 60 wt. %, or at least 70 wt. %, or at least 80 wt. %, or at least 90 wt. %, or 100 wt. % of liquid crystal polymer fibers, based on the total weight of the strands.

With continued reference to FIGS. 3 and 4, the strands 38 are shown with a first polymer coating 40 thereon. Liquid crystal polymers can have a relatively low surface energy that can be difficult for adhesion, and in some embodiments the first polymer coating can configured to promote adhesion to the liquid crystal polymer fibers. In some embodiments, the first polymer can include active or functional groups that can provide reactive sites which can promote adhesion of first polymer to the fibers or the strands. Examples of such active groups or functional groups include but are not limited to glycidyl, carboxyl, amino, hydroxyl, isocyanate, silane, melamine. In some embodiments, the first polymer can be subject to a curing reaction in place on the surface of the fibers or strands, which can promote adhesion of the first polymer to the fibers or strands. The curing reaction can involve chain extension (i.e., polymerization), chain scission, or cross-linking between polymer molecules, or any combination of these reactions. In some embodiments, the first polymer can provide a pressure-sensitive adhesive effect, which can promote adhesion between the first polymer and the fibers 32 or strands 38 and a second polymer 42. Examples of polymers useful for the first polymer coating 40 include but are not limited to acrylic polymers, epoxy polymers, urethane polymers, silane grafted polymer, melamine resins, acrylamide polymer.

In some embodiments, the first polymer coating 40 (or precursors thereof, e.g., monomers, pre-polymers, curing agents, or other reactants that form the final polymer) can be disposed onto the fibers as part of manufacture of the fibers, yarns, or strands. In some embodiments, fiber filaments can be coated with the first polymer as part of the fiber filament manufacturing process. In alternate embodiments, the first polymer coating can be applied as part of rope manufacturing, e.g., spraying or dipping the strands in a fluid composition comprising the first polymer or precursors thereof prior to application of the second polymer 42. Strands of the rope or the entire rope can be formed through operations such as twisting, winding, or braiding prior to, during, or after spraying or dipping with the fluid composition for forming the first polymer coating 40. In some embodiments, the first polymer coating can undergo a curing reaction (including a partial or post-cure reaction) in response to application of the second polymer 42 and/or in response to the conditions under which the second polymer 42 is applied.

The second polymer 42 can be applied by various mechanisms, including but not limited to extrusion, pultrusion, dip coating, spray coating, brush coating, or other coating methods. As with the first polymer coating 40, strands of the rope or the entire rope can be formed through operations such as twisting, winding, or braiding prior to application of the second polymer 42. For example, with respect to application of the second polymer by extrusion or pultrusion in the case of a rope as shown in FIG. 1, in some embodiments, the strands 36 can be twisted or wound into rope 30 before introduction to an extrusion/pultrusion station, and then extruded or pultruded along with the second polymer 42 through a die sized for the rope 30. In some embodiments, the strands 36 can be extruded/pultruded along with the second polymer 42 (through separate dies sized for the strands 36 or through a single larger dye) and subjected to twisting or winding upon emergence through the dye with the second polymer 42 still in a fluid state.

In some embodiments, the In some embodiments, including as shown in FIGS. 3 and 4, the second polymer 42 can provide an elastomeric matrix in which the fibers and/or strands are situated. Examples of elastomeric polymers for the second polymer include thermoplastic polyurethane (TPU), polyesters, polyamides, olefins elastomers, EPDM, fluoropolymers, chloropolymers, chlorosulfurno elastomers. Polyurethanes and polyesters can be provided with elastomeric properties through various approaches, including but not limited to the use of polyether polyol monomers or pre-polymers to incorporated flexible polyether segments into the molecular structure. Various commercially-available TPU and polyester compositions can provide targeted properties including but not limited to hardness, elasticity, tensile strength, torsion modulus, tear strength, creep performance, dependence of any of the above or other properties on temperature (e.g., heat-resistance). Blends of different polymers can be used to achieve targeted performance parameters.

In some embodiments, the outer surface of the rope can have characteristics that promote target performance for factors such as wear, abrasion, surface energy (e.g., for sliding performance). In some embodiments, the outer surface of the rope can be characterized by a hardness of at least 75 Shore A, or at least 80 Shore A, or at least 85 Shore A, or at least 90 Shore A, in each case according to according to DIN ISO 7619-1 (3s). Shore A hardness can range up as high as 62 D (greater than 100 A). In some embodiments, desired outer surface properties can be provided by the second polymer 42. In some embodiments, a third layer such as the third polymer layer 46 shown in FIG. 4 can be disposed as an outer layer on the rope 30. In some embodiments, the third polymer layer 46 can provide a Shore A hardness at any of the aforementioned values or ranges. Examples of polymers that can be used as third polymer layer 46 include TPU (which can be applied as an outer layer of an aqueous dispersion) or ethylene propylene diene polymer (EPDM). In some embodiments, an outer layer such as third polymer layer 46 can include additives such as a UV stabilizer (e.g., a benzotriazole derivative), flame retardant (e.g., organophosphorous compound) or antioxidant (e.g., hindered phenol).

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Unless otherwise stated, the term "or" means "and/or". It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A lifting member for an elevator system, comprising a rope formed from a plurality of strands, each of the strands comprising liquid crystal polymer fibers, said strands extending along a length of the lifting member;

a first polymer coating on outer surfaces of the fibers or on outer surfaces of the strands;

a second polymer coating disposed over the first polymer coating;

a third polymer coating disposed over the second polymer coating;

wherein the third polymer coating is formed from a material different than a material forming the second polymer coating.

2. The lifting member of claim 1, wherein the first polymer coating includes active groups selected from glycidyl, carboxyl, amino, isocyanate, amide or hydroxyl.

3. The lifting member of claim 1, wherein the first polymer coating comprises an acrylic polymer, an epoxy polymer, a urethane polymer, melamine resins, or acrylamide polymer.

4. The lifting member of claim 1, wherein the liquid crystal polymer comprises an aromatic polyester.

5. The lifting member of claim 1, wherein the strands comprise at least 50 wt. % liquid crystal polymer fibers, based on total weight of the strands.

6. The lifting member of claim 1, wherein the strands further comprise fibers selected from carbon fibers, glass fibers, polybenzoxazole fibers, or polyamide fibers.

7. The lifting member of claim 1, wherein the second polymer coating comprises an elastomeric polymer selected from polyamides, olefins, elastomers, EPDM, fluoropolymers, chloropolymers, or chlorosulfurno elastomers.

8. The lifting member of claim 1, wherein the third polymer coating comprises an ethylene propylene diene polymer.

9. The lifting member of claim 8, wherein the third polymer coating further includes a UV stabilizer or both a flame retardant and a UV stabilizer.

10. A method of making the lifting element of claim 1, the method comprising:

providing the plurality of strands comprising liquid crystal polymer fiber filaments, said fiber filaments or said strands coated with the first polymer coating or a precursor to the first polymer coating;

forming the plurality of strands into the rope;

disposing the second polymer coating over the plurality of strands;

disposing the third polymer coating over the second polymer coating as an outer layer of the rope.

11. The method of claim 10, further comprising forming said strands from said liquid crystal polymer fiber filaments, said filaments coated with the first polymer coating or precursor to the first polymer coating.

12. A method of making the lifting element of claim 1, the method comprising:

forming the plurality of strands comprising liquid crystal polymer fiber filaments into the rope;

impregnating the strands with a fluid composition comprising the first polymer coating or a precursor to the first polymer coating;

disposing the second polymer coating over the impregnated strands;

disposing the third polymer coating over the second polymer coating as an outer layer of the rope.

13. An elevator system, comprising a hoistway;

an elevator car disposed in the hoistway and movable therein; and a lifting member according to claim 1, said lifting member operably connected to the elevator car to suspend and/or drive the elevator car along the hoistway.

14. The elevator system of claim 13, wherein the first polymer coating includes active groups selected from glycidyl, carboxyl, amino, isocyanate, amide or hydroxyl.

15. The elevator system of claim 13, wherein the first polymer coating comprises an acrylic polymer, an epoxy polymer, a urethane polymer, melamine resins, or acrylamide polymer.

16. The elevator system of claim 13, wherein the liquid crystal polymer comprises an aromatic polyester.

17. The elevator system of claim 13, wherein the strands comprise at least 50 wt. % liquid crystal polymer fibers, based on total weight of the strands.

18. The elevator system of claim 13, wherein the strands further comprise fibers selected from carbon fibers, glass fibers, polybenzoxazole fibers, or polyamide fibers.

19. The elevator system of claim 13, wherein the second polymer coating comprises an elastomeric polymer selected from polyamides, olefins, elastomers, EPDM, fluoropolymers, chloropolymers, or chlorosulfurno elastomers.

20. The elevator system of claim 13, wherein the third polymer coating comprises an ethylene propylene diene polymer.

* * * * *